US005708985A

United States Patent [19]

Ogden

[11] Patent Number: 5,708,985

[45] Date of Patent: Jan. 20, 1998

[54] ENHANCED FRICTIONAL ENGAGEMENT SOCK

[75] Inventor: J. Michael Ogden, Cincinnati, Ohio

[73] Assignee: Ogden & Company, Inc., Cincinnati, Ohio

[21] Appl. No.: 747,333

[22] Filed: Nov. 12, 1996

[51] Int. Cl.[6] ..... A41B 11/00

[52] U.S. Cl. ..... 2/239; 66/178 R; 66/182

[58] Field of Search ..... 2/239, 240, 409; 66/182, 178, 185, 178 R, 178 A, 196

[56] References Cited

U.S. PATENT DOCUMENTS

| | | |
|---|---|---|
| D. 136,939 | 12/1943 | Herbert . |
| D. 136,945 | 12/1943 | Herbert . |
| 810,095 | 1/1906 | Thus . |
| 1,252,983 | 1/1918 | Ames . |
| 1,413,337 | 4/1922 | Landry . |
| 2,102,368 | 12/1937 | Martel . |
| 2,144,563 | 1/1939 | Davis . |
| 2,219,235 | 10/1940 | Morton . |
| 2,318,643 | 5/1943 | Thurston . |
| 2,370,450 | 2/1945 | Clarke . |
| 3,250,095 | 5/1966 | Bird . |
| 3,793,851 | 2/1974 | Thorneburg . |
| 3,796,067 | 3/1974 | East . |
| 4,104,892 | 8/1978 | Thorneburg . |
| 4,194,249 | 3/1980 | Thorneburg . |
| 4,255,949 | 3/1981 | Thorneburg . |
| 4,341,096 | 7/1982 | Safrit et al. . |
| 4,373,361 | 2/1983 | Thorneburg . |
| 4,397,161 | 8/1983 | Chesebro, Jr. et al. . |
| 4,467,626 | 8/1984 | Coble et al. . |
| 4,615,188 | 10/1986 | Hursh et al. . |
| 4,898,007 | 2/1990 | Dahlgren . |
| 5,095,548 | 3/1992 | Chesebro, Jr. . |
| 5,319,807 | 6/1994 | Brier . |

OTHER PUBLICATIONS

Cabela's—1994 Annual Fall Catalog Socks, pp. 140–141, Fall 1994.

*Primary Examiner*—Gloria Hale

*Attorney, Agent, or Firm*—Holland & Knight LLP

[57] ABSTRACT

A sock comprises a sole portion knitted with successive courses of yarn with a thickness defining an outer layer having a first surface, and which further includes a number of spaced ribs extending in a longitudinal direction between the heel and toe each formed by knitting a selected number of additional courses of yarn which extend from the first surface in a direction toward the instep portion of the sock in a position to contact the plantar surface of the foot. Individual ribs are either continuous in the transverse direction, or discontinuous, in which case transverse spaces are formed therealong in between sections of stitched yarn. The longitudinal space between adjacent ribs, and the transverse spaces within individual ribs, are of sufficient width to induce the skin of the plantar surface of the foot to at least partially extend therein so as to enhance the frictional engagement of the foot with the sock.

56 Claims, 4 Drawing Sheets

ENHANCED FRICTIONAL ENGAGEMENT SOCK

FIELD OF THE INVENTION

This invention relates to socks, and, more particularly, to a sock having a sole portion designed to enhance the frictional engagement with the skin of the plantar surface of the foot.

BACKGROUND OF THE INVENTION

There are a wide variety of sock designs particularly intended for active wear, such as various sports, walking, hiking and other leisure activities. Such designs can be generally classified into two broad categories, namely, socks intended to provide improved cushioning of the foot within a shoe, and socks where the control of moisture and/or heat build-up is the primary objective.

U.S. Pat. Nos. 4,194,249 and 4,397,161 are illustrative of socks particularly intended to enhance the cushioning effect of the sock within a shoe. Socks of this general design are formed with a comparatively thick sole portion which engages the plantar surface of the foot and functions as a compressive "shock absorber" within the shoe. In most instances, terry loops form the foot-engaging surface of the sole portion of the sock, and these terry loops extend continuously from the heel to the toe.

The control of moisture produced by the foot is usually accomplished by employing one or more moisture-wicking fibers throughout the sock, particularly along the sole portion and instep portion thereof. See, for example, U.S. Pat. Nos. 5,095,548 and 5,319,807. The objective of these sock designs is to wick away the moisture from the surface of the skin of the foot and transfer it through the sock to the upper of the shoe and/or to the insole upon which the plantar surface of the foot rests. In order to enhance moisture control, some socks incorporate air circulation channels formed in the instep portion and/or sole portion thereof which are designed to allow free passage of air into and out of the shoe and thus enhance moisture evaporation. One sock of this type is disclosed, for example, in the '807 patent noted above, and another is sold under the mark "PolySorb" which is commercially available from Spenco Medical Corp. of Waco, Tex. In these sock designs, the ventilation or air circulation channels comprise longitudinally spaced areas within the arch area between the heel and toe of the sock where a course of terry loops, for example, is omitted. This forms narrow passages or channels which do not make contact with any portion of the skin of the foot thus allowing air to pass therethrough which enhances evaporation of the moisture wicked away from the skin of the foot by fibers within the sock. The air channels are positioned only in the area of the sock which covers the arch because the least amount of body weight is applied at that location, compared to the ball and heel of the foot, making it unlikely that the foot will interfere with the passage of air through such channels.

Moisture wicking and evaporation, and shock absorption of compressive forces, with which the above-described sock designs are concerned, are only two factors contributing to "in-shoe dynamics," i.e., the dynamic relationship between the foot, sock and interior of an article of footwear. Each of the above-described sock designs fail to consider one critical aspect of in-shoe dynamics, namely, side-to-side, front-to-back and rotational movement of the foot and/or sock within the interior of an article of footwear in response to the application of a shear force thereto as a result of a particular activity.

In-shoe dynamics in the context of improved insole designs, i.e., that portion of the interior of a shoe which contacts the plantar surface of the foot and the sole portion of a sock, have been addressed in the inventor's prior U.S. Pat. No. 4,893,418. As discussed therein, one problem with many insole and shoe designs is a failure to account for motion of the sock of the wearer relative to the insole, and/or the motion of the foot of the wearer with respect to the sock. In many articles of footwear, a top surface of the insole is formed of a tacky or sticky material, or a material which becomes relatively tacky when exposed to the moisture from the foot. Insoles of this type exhibit a higher coefficient of friction than the coefficient of friction of the skin of the foot. As a result, the magnitude of the frictional engagement between the sock and insole is greater than the magnitude of the frictional engagement between the foot and sock. Articles of footwear provided with this type of insole have been found to create blisters on the foot during use because the foot is allowed to move within the sock in response to the application of a shear force causing front-to-back, side-to-side and/or rotational foot motion, while the sock is held in an essentially fixed position atop the insole. The rubbing motion of the foot within the sock can create severe blistering and discomfort, particularly in vigorous athletic activities.

The socks described above fail to alleviate such problems with many current insole designs, and, indeed, it is apparent that the magnitude of the frictional engagement between the foot and sock, as compared to the extent of frictional engagement between the sock and insole, is not even a design consideration in such prior socks. Socks having thick, bulky and "cushiony" sole portions are concerned solely with the compressive forces transmitted from the shoe to the foot, i.e., as the heel and ball areas of the foot make contact through the shoe with a particular surface. In fact, bulky, highly cushioning socks often permit increased side-to-side, front-to-back and/or rotation of movement of the foot relative to the sock in response to the application of shear forces to the foot as the shoe itself is moved in such directions during athletic activities and other active wear. The same limitations are found in moisture-absorbing socks which are concerned essentially only with enhancing comfort by wicking away moisture from the foot and causing it to evaporate.

In both types of socks described above, the sock becomes damp with moisture causing the facing surface of the insole to dampen. The frictional engagement between the sock-insole surface is increased when both of these surfaces become moist, causing the frictional engagement therebetween to exceed the coefficient of friction or frictional force between the sock and skin of the foot. Consequently, shear forces imposed on the foot causes the foot to move with respect to the sock, instead of allowing the foot and sock to move together, as a unit, relative to the insole. As noted above, this creates blisters and other soft tissue damage to the foot and severe discomfort.

SUMMARY OF THE INVENTION

It is therefore among the objectives of this invention to provide a sock which provides enhanced comfort, and which avoids blistering and other soft tissue damage to the plantar surface of the foot.

These objectives are accomplished in a sock having a sole portion knitted with successive courses of yarn with a thickness defining an outer layer having an inner surface, and which further includes a number of spaced ribs extending in a longitudinal direction between the heel and toe each formed by knitting a selected number of additional courses of yarn which extend from the inner surface of the outer layer in a direction toward the instep portion of the sock in a position to contact the plantar surface of the foot. Individual ribs are either continuous in the transverse direction, or discontinuous in which case transverse spaces are formed at intervals therealong. The longitudinal space between adjacent ribs, and the transverse spaces within individual ribs, are of sufficient width to permit the skin of the plantar surface of the foot to at least partially extend therein so as to enhance the frictional engagement between the foot and the sock.

This invention is predicated upon the concept of creating improved in-shoe dynamics by enhancing the frictional engagement between the plantar surface of the foot and the sole portion of the sock herein. While also providing cushioning against compressive forces imposed on the foot, the unique longitudinally spaced rib design of this invention, which, in alternative embodiments includes ribs with transverse spaces, "captures" portions of the skin of the plantar surface of the foot within such spaces so as to increase the frictional engagement therebetween and reduce relative motion between the foot and sock within the shoe.

None of the sock designs described above address the problems solved by this invention. Although longitudinally spaced air channels, or ventilation areas, have been suggested in other sock designs, such channels must be sufficiently narrow, and are located only in the area where the sock contacts the arch of the foot, in order to prevent the skin of the foot from entering such channels so that they remain unobstructed and permit the passage of air therethrough. As noted above, the objective of those sock designs is to allow the free passage of air through the sock to enhance evaporation of the moisture wicked away from the surface of the skin by moisture wicking fibers in the sock. In contrast, the spaces between and within the ribs on the sole portion of the sock herein are a sufficient distance apart to cause the skin of the plantar surface of the foot to move therein, thus increasing the frictional engagement therebetween.

In the presently preferred embodiment of this invention, the yarns which form the outer layer are chosen from the group consisting of acrylic, LYCRA(spandex)-covered nylon, LYCRA(spandex), stretch polyester and cotton. The term "Lycra" is a trademark of E. I. dupont de Nemours & Company, Inc. Preferably, a combination of these fibers is knitted in a flat knit at least within the sole portion of the sock and preferably along the instep portion as well. The longitudinally spaced ribs are preferably formed with a terry stitch of "Cool-Max," which is a registered trademark of E. I. dupont de Nemours & Company, or other suitable moisture-wicking fiber. It is also contemplated that the ribs can be formed of additional courses of flat stitch, as desired. The underlying combination of fibers within the sole portion of the sock provides good abrasion resistance and stretch, whereas the Cool-Max fiber provides comfort, cushioning and a moisture wicking ability.

In one presently preferred embodiment, each of the ribs, and the longitudinal spaces therebetween, have a width dimension measured in the longitudinal direction. In the presently preferred embodiment, the width of each rib is in the range of about 5–10 mm, whereas the width of the spaces between adjacent ribs is in the range of about 4–8 mm. Expressed in other terms, each rib is formed with in the range of about 5–10 side-by-side courses of knitted yarn using terry loops, or, alternatively, several additional layers of the same number of courses of flat stitch. The longitudinal spaces between adjacent ribs are formed with a flat knit, and preferably include in the range of about 4–8 courses each. The height dimension of the ribs, measured in the direction from the top or first surface formed by the combination of yarns toward the instep portion of the sock, is preferably on the order of about 2–4 mm.

In an alternative embodiment, the ribs are discontinuous or interrupted in the transverse direction forming transverse spaces between adjacent knitted sections of terry loops or flat stitch. Preferably, the transverse spaces within individual ribs have a dimension of about 4–8 mm measured in the transverse direction whereas the knitted areas therebetween are about 5–10 mm.

DESCRIPTION OF THE DRAWINGS

The structure, operation and advantages of the presently preferred of this invention will become further apparent upon consideration of the following description, taken in conjunction with the accompanying drawings, wherein.

DETAILED DESCRIPTION OF THE PREFERRED EMBODIMENT

Figure 1:
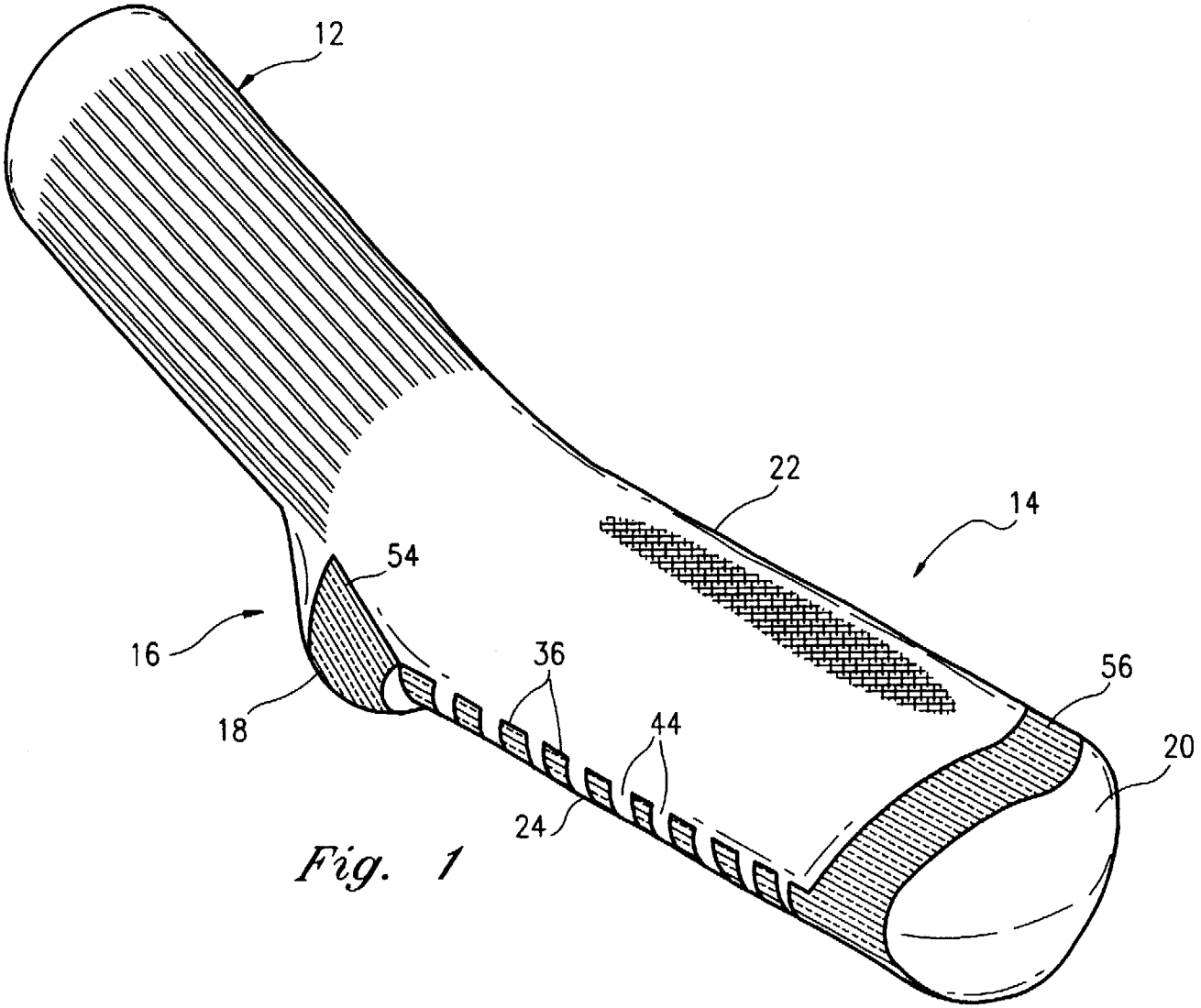
FIG. 1 is a perspective view of one embodiment the sock of this invention.
Figures 2, 3:
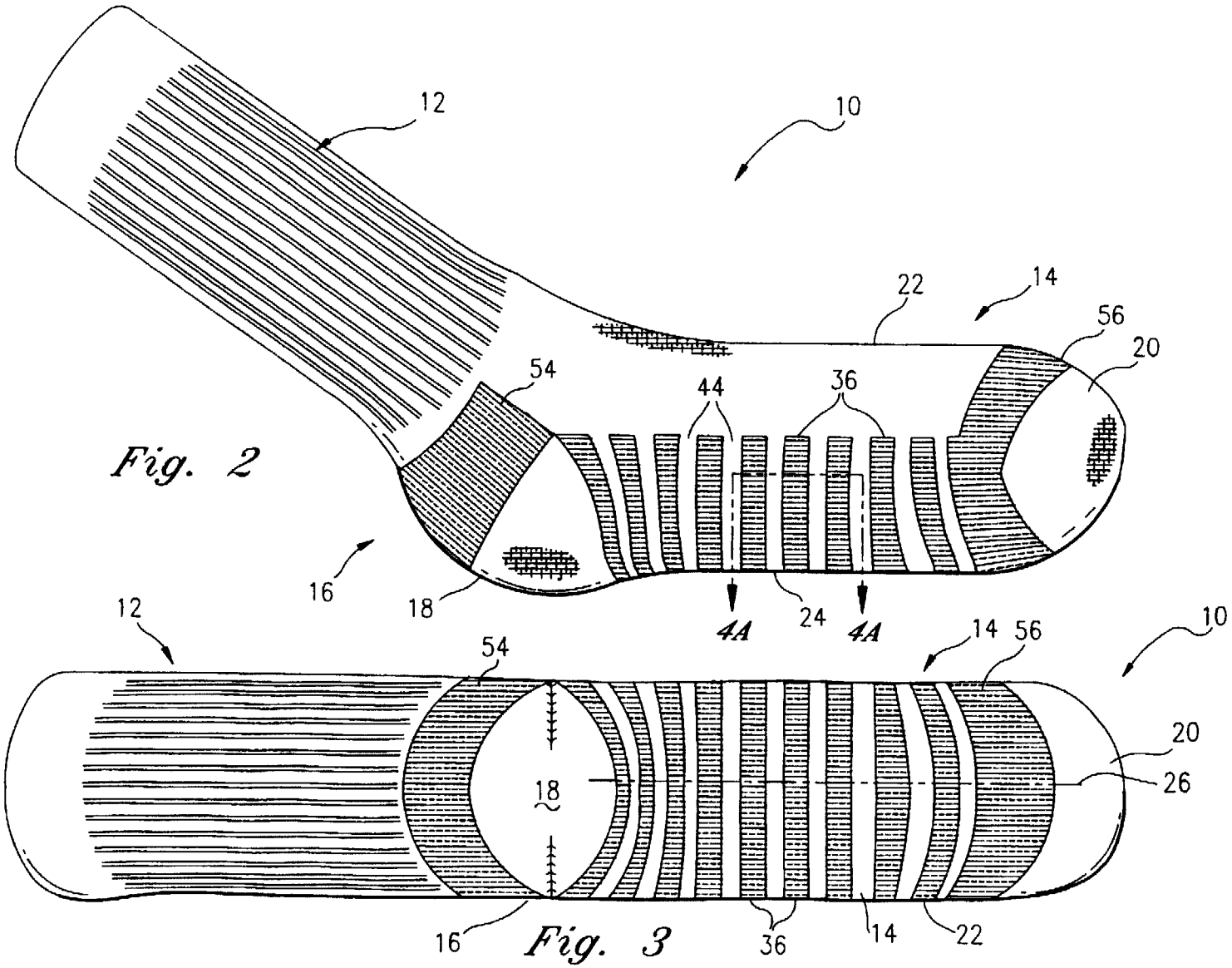
FIG. 2 is a side view of the sock depicted in FIG. 1.
FIG. 3 is a bottom plan view of the sock herein.

With reference initially to the embodiment shown in FIGS. 1–3, the sock 10 of the invention comprises a leg portion 12 and a foot portion 14. The foot portion 14 has a heel 16 at one end, preferably including a heel pocket 18, and a toe 20 at the opposite end. Extending between the heel 16 and toe 20 are an instep portion 22 engageable with the upper half of the foot, and a sole portion 24 engageable with the bottom half of the foot. The instep portion 22 and sole portion 24 have opposed sides which are joined together along their edges to form the completed foot portion 14 of the sock 10.

Except as discussed in detail below, the leg portion 12 and foot portion 14 are integrally knitted in a well-known fashion by any one of a number of commercially available automatic knitting machines. The details of such knitting operation form no part of the invention, and are therefore not described herein. For purposes of the present discussion, the term "longitudinal" refers to a direction along the longitudinal axis 26 depicted schematically in FIG. 3 which extends between the heel 16 and toe 20 of the sock 10. The term "transverse" is meant to refer to a direction perpendicular to the longitudinal axis 26, or in a side-to-side direction between the opposed sides of the instep portion 22 and sole portion 24 of the sock 10. The terms "outer" or "exterior" are meant to refer to the outside or exterior of the sock 10 which would contact the inside of a shoe. The terms "inner" or "interior," on the other hand, refer to the interior or inside of the sock 10 which contacts the foot and leg of the wearer.

Figure 4A:
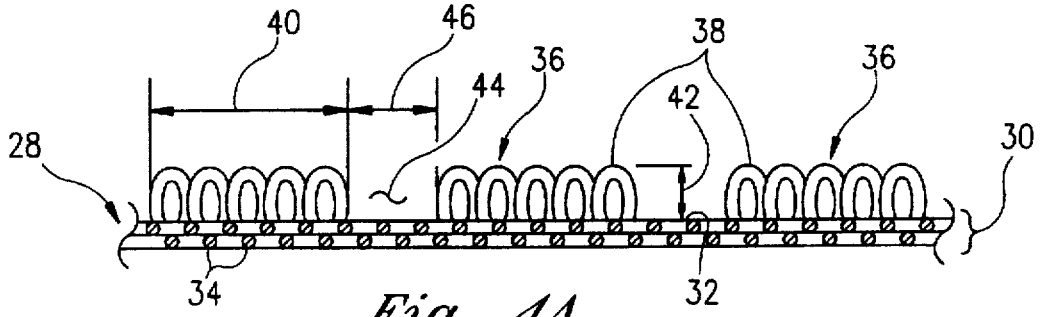
FIG. 4A is a cross-sectional view taken generally along lines 4A—4A of FIG. 2, depicting the sock in an unstretched state.
Figure 4B:
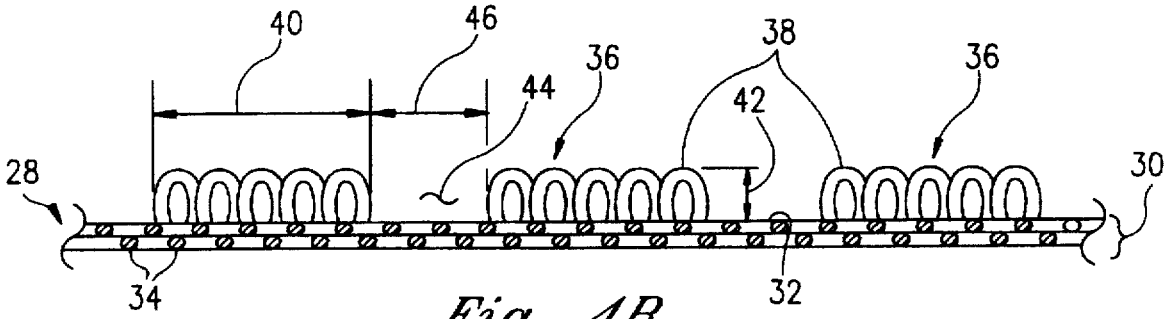
FIG. 4B is a view similar to FIG. 4A except with a sock in a fully stretched configuration.

With additional reference to FIGS. 4A and 4B, the novelty of this invention resides primarily in the construction of the sole portion 24 of sock 10. In the presently preferred embodiment, the sole portion 24 is initially formed with an outer layer 28 consisting of at least one course of yarns preferably knitted with a flat knit stitch. The outer layer 28 has a width dimension depicted in the drawings with the reference number 30, and a top or inner surface 32 which faces the interior of the sock 10. Preferably, the outer layer 28 is knitted from a combination of yarns 34 chosen from the group consisting of acrylic, LYCRA(spandex), LYCRA (spandex)-covered nylon, stretch polyester and cotton. The acrylic yarn provides a desirable feel or "hand" to the knitted fabric, softness, high bulk, good moisture wicking ability and resistance to abrasion. Cotton can be utilized as a substitute for acrylic, but is less desirable because it does not exhibit all of the properties of acrylic mentioned above. Stretch polyester, LYCRA(spandex) and LYCRA (SPANDEX)-covered nylon all impart a stretching property, and are utilized both in the outer layer 28 of sole portion 24 and in the instep portion 22. Consequently, the foot portion 14 of the sock 10 herein has the capability of stretching in a longitudinal direction, as described in more detail below.

As best shown in FIGS. 2–4B, the sole portion 24 of sock 10 further includes a number of longitudinally spaced ribs 36 which extend substantially parallel to one another from approximately the heel 16 to the toe 20 of sock 10. Each of the ribs 36 is defined by at least one additional layer of yarn which, in the embodiment of FIGS. 4A and 4B, is knitted with terry loops 38 depicted schematically in such Figures. The terry loops 38 extend from the inner surface 32 of outer layer 28 inwardly, i.e., within the interior of the sock 10 in a direction toward the instep portion 22 thereof. As noted above, the yarn forming ribs 36 is preferably Cool-Max, or other suitable moisture-wicking yarns, which provide exceptional cushioning and resistance to abrasion in addition to moisture-wicking ability. Preferably, the Cool-Max yarn is dyed a different color than the remaining yarn within the sock 10 to provide a distinctive look to the finished article.

Figure 4C:
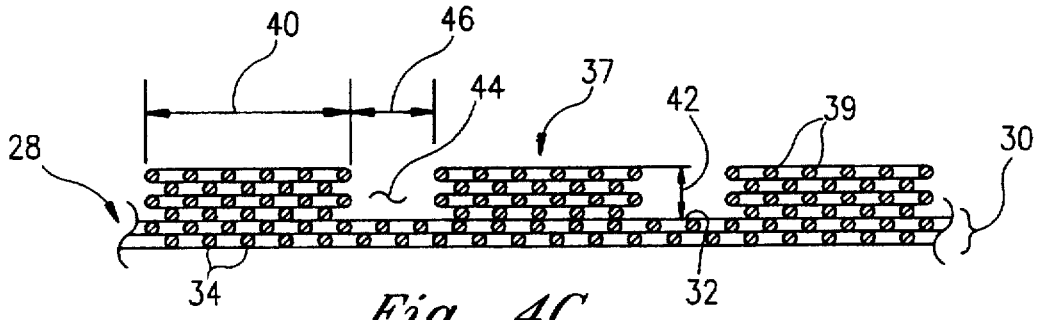
FIG. 4C is a view similar to FIG. 4A except of an alternative rib configuration of the socks herein.

In an alternative embodiment depicted in FIG. 4C, ribs 37 are formed by multiple additional courses of flat stitch 39 instead of terry loops 38. The additional courses of flat stitch 39 extend from the outer layer 28 and form ribs 37 having approximately the same height and width dimension as the ribs 36. As such, the same reference numbers employed below to describe the details of ribs 36 in the embodiment of FIGS. 4A and 4B are used to identify the same structure in FIG. 4C. Further, while the discussion of the sole portion 24 herein refers to FIGS. 4A and 4B, it should be understood that such description applies equally to the embodiment of FIG. 4C.

As shown in FIGS. 4A and 4B, each of the ribs 36 has a width dimension 40 and a height dimension 42, with adjacent ribs 36 being longitudinally spaced from one another by gaps or spaces 44, which, in turn, have their own width dimension 46. The width dimension 46 of each longitudinal space 44, i.e., the longitudinal distance between adjacent ribs 36, is intended to be sufficient to allow the skin on the plantar surface of the foot to at least partially extend into such spaces 44 and below the plane of the ribs 36 along sole portion 24. As such, the skin of the plantar surface of the foot is "captured" between adjacent ribs 36 so as to substantially increase the frictional engagement between the sole portion 24 of the sock 10 and the foot, particularly in the longitudinal, or "front-to-back" direction.

The width dimension 40 of ribs 36 and width dimension 46 of longitudinal spaces 44 can be expressed in terms of dimensional measurements, and/or the number of courses, i.e., the number of side-by-side knitted rows of yarn which form the outer layer 28 and the ribs 36 of sole portion 24. With respect to physical measurements of such width dimensions 40 and 46, it should be noted that consistent with current retail practice, one sock is intended to fit a range of foot sizes so that retailers need not stock a separate sock size for each foot size. The LYCRA(SPANDEX), LYCRA (spandex) LYCRA-covered nylon and/or stretch polyester employed in the sole portion 24 and instep portion 22 of the sock 10 herein permits one sock 10 to fit a number of different foot sizes. FIG. 4A depicts a portion of the sole portion 24 of the sock 10 in a rest or unstretched condition, whereas FIG. 4B illustrates how the sole portion 24 is stretched when a larger foot (not shown) is inserted into the sock 10. As such, a range of width dimensions 40 and 46 are considered to be applicable and within the scope of this invention depending upon whether, and to what extent, the sock 10 is stretched in the longitudinal direction. Preferably, the width dimension 40 of each rib 36 is in the range of about 5–10 mm, and the width dimension 46 of each longitudinal space 44 between adjacent ribs 36 is in the range of about 4–8 mm. Additionally, the height dimension 42 of each rib 36 is preferably in the range of about 2–4 mm without the presence of a foot within the sock 10.

It is also contemplated that the width of each rib 36, and the width of the longitudinal spaces 44 therebetween, can be expressed in terms of the number of "courses" or successive side-by-side knitted rows of yarn are employed. In that connection, it should be understood that there are a number of commercially available knitting machines which are designed to operate with yarns of different thicknesses. For example, a 54 needle count knitting machine is typically utilized to manufacture heavy work or athletic socks having comparatively thick yarn, whereas a 160 needle count knitting machine employs thin yarn to knit thin dress socks and the like. As such, the number of courses which are knitted to form each rib 36, and the longitudinal spaces 44 therebetween, varies depending on the type of knitting machine utilized and the thickness of the yarn.

By way of example, a 108 needle count machine has been employed in the manufacture of sock 10. With this machine, each rib 36 is formed with in the range of about 5 to 10 courses of terry loops, whereas the longitudinal spaces 44 between adjacent ribs 36 are formed with in the range of about 4 to 8 courses of flat knit stitches. As such, the ratio of the width dimension 40 of the ribs 36 to the width dimension 46 of the longitudinal spaces 44 is preferably in the range of 1:1 to 2:1, i.e., wherein the width of the ribs 36 is about the same as or up to about two times greater than the width of the longitudinal spaces 44.

As shown in FIGS. 2 and 3, the ribs 36 are oriented substantially parallel on another along the sole portion 24 and extend generally from the heel 16 to the toe 20. Additionally, in such embodiment, the ribs 36 extend continuously in a transverse direction from one side of the sole portion 24 to the other. Further, one or more ribs 36 could be eliminated entirely, particularly in the arch area of the plantar surface of the foot.

Figure 5:
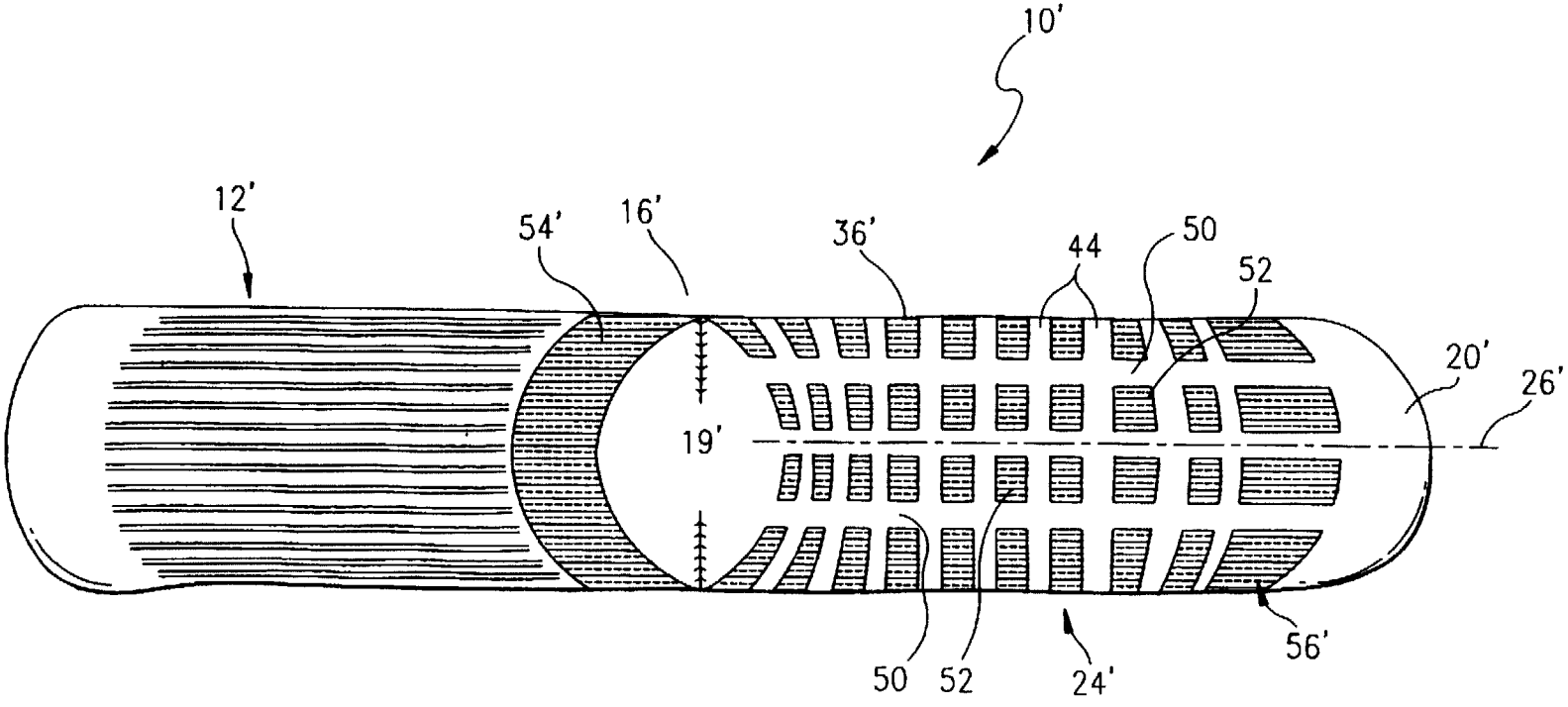
FIG. 5 is a view similar to FIG. 3 but of an alternative embodiment of this invention.

An alternative embodiment of a sock 10' is depicted in FIG. 5, which has a similar construction as sock 10 except for the rib configuration. The same reference numbers are therefore used in FIG. 5 to designate the same elements as in the previous embodiment, with the addition of a "'" in FIG. 5. The ribs 36' of sock 10' are discontinuous or interrupted in the side-to-side or transverse direction forming a "checkerboard" configuration wherein each rib 36' consists of one or more transverse spaces 50, with stitched sections 52 of terry loops or additional flat stitch therebetween. Adjacent ribs 36', in turn, are separated from one another by the same longitudinal spaces 44 as in the previously described embodiment.

Preferably, the ribs 36' of sock 10' have the same width dimension 40 and height dimension 42 as the ribs 36 of sock 10. See FIGS. 4A and 4B. Further, as noted above, the transversely spaced stitched sections 52 can be formed of terry loops as in FIGS. 4A and 4B or additional layers of flat stitch as in FIG. 4C. In the presently preferred embodiment, each of the transverse spaces 50 between adjacent stitched sections 52 within individual ribs 36' has a length, measured in the transverse direction, of in the range of about 4–8 mm. The stitched sections 52, between the transverse spaces 50, preferably have a length in the range of 5–10 mm also measured in the transverse direction.

An important aspect adjacent ribs 36, 36 the spacing between adjacent ribs 36, 36', and, in the embodiment of FIG. 5, within individual ribs 36'. Unlike prior sock designs, the longitudinal spaces 44 and transverse spaces 50 are specifically designed to induce the skin of the plantar surface of the foot to extend therein to substantially increase the frictional engagement between the sole portion of the socks 10, 10' and the foot. As a result, the foot and sock tend to move as a unit within the interior of a shoe in response to the application of side-to-side, back-to-front and/or rotational shear forces thus allowing the socks 10 and 10' to act as a protective layer for the foot as the foot and sock move within the shoe. This substantially reduces the incidence of blisters and other soft tissue damage to the foot which would otherwise be permitted if the foot were allow to move with respect to the sock inside of the shoe.

It is contemplated that the embodiment of sock 10 illustrated in FIGS. 1–3 would be particularly advantageous in activities where limited side-to-side or rotational shear forces are imposed on the foot and front-to-back shear forces predominate, such as during running, walking, hiking and similar activities. The continuous, longitudinally spaced ribs 36, with longitudinal spaces 44 therebetween, are effective to resist front-to-back movement of the plantar surface of the foot with respect to the sock 10. With the addition of transverse spaces 50 and discrete stitched sections 52 in the ribs 36' of sock 10', not only is the foot constrained from front-to-back motion relative to the sock 10' but side-to-side and rotational movement of the foot within the sock 10' is resisted due to the "capture" of the skin of the plantar surface of the foot within the transverse spaces 50. The sock 10' is therefore advantageously used in a variety of court sports such as basketball, volleyball, racquetball, handball, etc., and other sports where the foot is subjected to movement in essentially all directions, e.g., tennis, football, soccer, baseball, etc.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, both socks 10 and 10' have been depicted with a section 54, 54' of terry loops stitched at the heel 16, 16' thereof, and a section 56, 56' of terry loops stitched at the toe 20, 20'. These sections 54, 56 of sock 10 and 54', 56' of sock 10' are intended to enhance the comfort of socks 10, 10', but are optional and could be omitted if desired. Additionally, while the outer layer 28 and ribs 36, 36' and 37 are shown as being knitted with the same yarn, it is contemplated that a different, and preferably heavier, yarn could be utilized to form the ribs 36, 36', 37 compared to the outer layer 28.

Therefore, it is intended that the invention not be limited to the particular embodiment disclosed as the best mode contemplated for carrying out this invention, but the invention will include all embodiments falling within the scope of the appended claims.

What is claimed is:

1. A sock, comprising:

an integrally knitted leg portion and a foot portion, said foot portion including a toe at one end, a heel at the other end connected to said leg portion, a sole portion engageable with the lower half of the foot, and an instep portion engageable with the upper half of the foot, said sole portion and instep portion extending in a longitudinal direction between said heel and toe portions and having opposed sides which are joined together;

said sole portion being knitted with successive courses of yarn having a thickness defining an inner surface and an outer surface, said sole portion further including longitudinally spaced ribs formed by at least one additional knitted course of yarn extending from said inner surface in a direction toward said instep portion and in a position to contact the plantar surface of a foot, each of said spaces between adjacent ribs being sufficiently wide to induce the skin of the plantar surface of the foot to at least partially extend into said spaces so as to enhance the frictional engagement between said sole portion and the plantar surface of the foot.

2. The sock of claim 1 in which said sole portion is formed with flat stitch throughout said thickness thereof to said inner surface.

3. The sock of claim 2 in which said ribs are formed of additional courses of flat stitch.

4. The sock of claim 1 in which said ribs are formed of terry loops.

5. The sock of claim 1 in which each of said ribs has a height dimension measured from said inner surface in a direction toward said instep portion, said height dimension being in the range of about 2–4 mm.

6. The sock of claim 1 in which said longitudinal space between adjacent ribs is in the range of about 4–8 mm.

7. The sock of claim 1 in which each of said ribs has a width dimension, measured in said longitudinal direction, which is in the range of about 5–10 mm.

8. The sock of claim 1 in which said ribs extend in a longitudinal direction between said toe portion and said heel portion.

9. The sock of claim 1 in which said ribs are oriented substantially parallel to one another extending in said longitudinal direction along said sole portion.

10. The sock of claim 1 in which each of said ribs is substantially continuous along said sole portion in a transverse direction perpendicular to said longitudinal direction.

11. The sock of claim 1 in which at least some of said ribs extending along said sole portion are discontinuous in a transverse direction perpendicular to said longitudinal direction forming transverse spaces between stitched sections where said at least one additional course of yarn is knitted.

12. The sock of claim 11 in which said transverse spaces between adjacent stitched sections are each in the range of about 4–8 mm measured in the transverse direction.

13. The sock of claim 11 in which said stitched sections between said transverse spaces each are in the range of about 5–10 mm measured in the transverse direction.

14. The sock of claim 1 in which said sole portion is knitted with a number of yarns forming said successive courses defining said inner and outer surfaces, said yarns having properties including softness, high bulk, moisture-wicking, resistance to abrasion and/or stretching.

15. The sock of claim 1 in which said ribs are formed of a moisture-wicking yarn.

16. The sock of claim 15 in which said moisture-wicking yarn is dyed a different color than the yarn forming the remainder of said sole portion.

17. The sock of claim 1 in which each of said ribs is formed by knitting in the range of about 5–10 courses of yarn, and said longitudinal spaces between adjacent ribs are formed by knitting in the range of about 4–8 successive courses of yarn.

18. The sock of claim 1 in which each of said ribs, and each of said spaces between adjacent ribs, has a width dimension measured in said longitudinal direction, the ratio of said width dimension of said ribs to said width dimension of said spaces being in the range of about 1:1 to 2:1.

19. A sock comprising:

an integrally knitted leg portion and a foot portion, said foot portion including a toe at one end, a heel at the other end connected to said leg portion, a sole portion engageable with the lower half of the foot, and an instep portion engageable with the upper half of the foot, said sole portion and instep portion extending in a longitudinal direction between said heel and toe portions and having opposed sides which are joined together;

said sole portion being knitted with successive courses of yarn having a thickness defining an inner surface and an outer surface, said sole portion further including longitudinally spaced ribs formed by at least one additional knitted course of yarn extending from said inner surface in a direction toward said instep portion and in a position to contact the plantar surface of a foot, each of said ribs and each of said spaces between adjacent ribs having a width dimension measured in said longitudinal direction, said width dimension of said ribs being in the range of about 5–10 mm and said width dimension of said spaces being in the range of about 4–8 mm.

20. The sock of claim 19 in which said sole portion is formed with flat stitch throughout said thickness thereof to said inner surface.

21. The sock of claim 20 in which said ribs are formed of additional courses of flat stitch.

22. The sock of claim 19 in which said ribs are formed of terry loops.

23. The sock of claim 19 in which each of said ribs has a height dimension measured from said inner surface in a direction toward said instep portion, said height dimension being in the range of about 2–4 mm.

24. The sock of claim 19 in which said ribs extend in a longitudinal direction between said toe portion and said heel portion.

25. The sock of claim 19 in which said ribs are oriented substantially parallel to one another extending in said longitudinal direction along said sole portion.

26. The sock of claim 19 in which each of said ribs is substantially continuous along said sole portion in a transverse direction perpendicular to said longitudinal direction.

27. The sock of claim 19 in which at least some of said ribs extending along said sole portion are discontinuous in a transverse direction perpendicular to said longitudinal direction forming transverse spaces between stitched sections where said at least one additional course of yarn is knitted.

28. The sock of claim 27 in which said transverse spaces between adjacent stitched sections are each in the range of about 4–8 mm measured in the transverse direction.

29. The sock of claim 27 in which said stitched sections between said transverse spaces each are in the range of about 5–10 mm measured in the transverse direction.

30. The sock of claim 19 in which each of said ribs is formed by knitting in the range of about 5–10 courses of yarn, and each of said longitudinal spaces between adjacent ribs is formed by knitting in the range of about 4–8 courses of yarn.

31. A sock comprising:

an integrally knitted leg portion and a foot portion, said foot portion including a toe at one end, a heel at the other end connected to said leg portion, a sole portion engageable with the lower half of the foot, and an instep portion engageable with the upper half of the foot, said sole portion and instep portion extending in a longitudinal direction between said heel and toe portions and having opposed sides which are joined together;

said whole portion being knitted with successive courses of a combination of yarns having thickness defining an inner surface and an outer surface, said combination of yarns having properties including softness, high bulk, moisture-wicking resistance to abrasion and/or stretching;

said sole portion further including longitudinally spaced ribs formed by at least one additional course of a moisture-wicking yarn extending from said inner surface in a direction toward said instep portion and in a position to contact the plantar surface of a foot, each of said spaces between adjacent ribs being sufficiently wide to permit the skin of the plantar surface of the foot to at least partially extend into said spaces so as to enhance the frictional engagement between the sole portion and the plantar surface of the foot.

32. The sock of claim 31 in which said moisture-wicking yarn is dyed a different color than the yarn forming the remainder of said sole portion.

33. The sock of claim 31 in which said combination of yarns is knitted with a flat stitch.

34. The sock of claim 33 in which said ribs are formed of additional courses of flat stitch.

35. The sock of claim 31 in which said moisture-wicking yarn forming said ribs is knitted with terry loops.

36. The sock of claim 31 in which each of said ribs has a height dimension measured from said inner surface in a direction toward said instep portion, said height dimension being in the range of about 2–4 mm.

37. The sock of claim 31 in which said longitudinal space between adjacent ribs is in the range of about 4–8 mm.

38. The sock of claim 31 in which each of said ribs has a width dimension, measured in said longitudinal direction, which is in the range of about 5–10 mm.

39. The sock of claim 31 in which said ribs extend in a longitudinal direction between said toe portion and said heel portion.

40. The sock of claim 31 in which said ribs are oriented substantially parallel to one another extending in said longitudinal direction along said sole portion.

41. The sock of claim 31 in which each of said ribs is substantially continuous along said sole portion in a transverse direction perpendicular to said longitudinal direction.

42. The sock of claim 31 in which at least some of said ribs extending along said sole portion are discontinuous in a transverse direction perpendicular to said longitudinal direction forming transverse spaces between stitched sections where said at least one additional course of yarn is knitted.

43. The sock of claim 42 in which said transverse spaces between adjacent stitched sections are each in the range of about 4–8 mm measured in the transverse direction.

44. The sock of claim 42 in which said stitched sections between said transverse spaces each are in the range of about 5–10 mm measured in the transverse direction.

45. The sock of claim 31 in which each of said ribs is formed by knitting in the range of about 5–10 courses of yarn and said longitudinal spaces between adjacent ribs being formed by knitting in the range of about 4–8 successive courses of yarn.

46. A sock, comprising:

an integrally knitted leg portion and a foot portion, said foot portion including a toe at one end, a heel at the other end connected to said leg portion, a sole portion engageable with the lower half of the foot, and an instep portion engageable with the upper half of the foot, said sole portion and instep portion extending in a longitudinal direction between said heel and toe portions and having opposed sides which are joined together;

said sole portion being knitted with successive courses of yarn having a thickness defining an inner surface and an outer surface, said sole portion further including individual ribs which are each formed by at least one additional knitted course of yarn extending from said inner surface in a direction toward said instep portion and in a position to contact the plantar surface of a foot;

said sole portion being formed with a longitudinal space between adjacent ribs, at least some of said individual ribs being discontinuous in a transverse direction, which is substantially perpendicular to said longitudinal direction, thus forming transverse spaces in between stitched sections of yarn, each of said longitudinal spaces between adjacent ribs and each of said transverse spaces within individual ribs being sufficiently wide to induce the skin of the plantar surface of the foot to at least partially extend into said longitudinal spaces and into said transverse spaces so as to enhance the frictional engagement between said sole portion and the plantar surface of the foot.

47. The sock of claim 46 in which said sole portion is formed with flat stitch throughout said thickness thereof to said inner surface.

48. The sock of claim 47 in which said ribs are formed of additional courses of flat stitch.

49. The sock of claim 46 in which said ribs are formed of terry loops.

50. The sock of claim 46 in which each of said ribs has a height dimension measured from said inner surface in a direction toward said instep portion, said height dimension being in the range of about 2–4 mm.

51. The sock of claim 46 in which said longitudinal space between adjacent ribs is in the range of about 4–8 mm.

52. The sock of claim 46 in which each of said ribs has a width dimension, measured in said longitudinal direction, which is in the range of about 5–10 mm.

53. The sock of claim 46 in which said ribs extend in a longitudinal direction between said toe portion and said heel portion.

54. The sock of claim 46 in which said ribs are oriented substantially parallel to one another extending in said longitudinal direction along said sole portion.

55. The sock of claim 46 in which said transverse spaces each are in the range of about 4–8 mm measured in said transverse direction.

56. The sock of claim 46 in which said stitched sections between said transverse spaces are in the range of about 5–10 mm measured in the transverse direction.

* * * * *